US011053774B2

(12) United States Patent
Johnson et al.

(10) Patent No.: US 11,053,774 B2
(45) Date of Patent: Jul. 6, 2021

(54) TUBING OR ANNULUS PRESSURE OPERATED BOREHOLE BARRIER VALVE

(71) Applicant: Baker Hughes, LLC, Houston, TX (US)

(72) Inventors: Michael H. Johnson, Katy, TX (US); Todd C. Jackson, Houston, TX (US)

(73) Assignee: BAKER HUGHES, A GE COMPANY, Houston, TX (US)

( * ) Notice: Subject to any disclaimer, the term of this patent is extended or adjusted under 35 U.S.C. 154(b) by 0 days.

(21) Appl. No.: 16/876,462

(22) Filed: May 18, 2020

(65) Prior Publication Data

US 2020/0291749 A1 Sep. 17, 2020

Related U.S. Application Data

(62) Division of application No. 15/679,539, filed on Aug. 17, 2017, now Pat. No. 10,704,363.

(51) Int. Cl.

| | |
|---|---|
| ***E21B 34/14*** | (2006.01) |
| ***E21B 23/00*** | (2006.01) |
| ***E21B 34/08*** | (2006.01) |
| ***E21B 34/10*** | (2006.01) |

(52) U.S. Cl.

CPC ..... *E21B 34/14* (2013.01); *E21B 23/004* (2013.01); *E21B 34/08* (2013.01); *E21B 34/101* (2013.01); *E21B 2200/04* (2020.05)

(58) Field of Classification Search

CPC ..... E21B 2200/04; E21B 2200/06; E21B 23/004; E21B 34/08; E21B 34/10; E21B 34/101; E21B 34/14

See application file for complete search history.

(56) References Cited

U.S. PATENT DOCUMENTS

| | | | | |
|---|---|---|---|---|
| 5,542,472 | A * | 8/1996 | Pringle | B21C 37/0815 166/65.1 |
| 2009/0065218 | A1* | 3/2009 | Loretz | E21B 34/10 166/375 |
| 2009/0218096 | A1* | 9/2009 | Vick, Jr. | F16K 31/1221 166/250.15 |
| 2010/0206579 | A1* | 8/2010 | Guven | E21B 23/006 166/373 |
| 2011/0132618 | A1* | 6/2011 | Panian | E21B 34/10 166/373 |
| 2013/0056222 | A1* | 3/2013 | Smith | E21B 17/1035 166/378 |
| 2013/0118758 | A1* | 5/2013 | Caminari | F17D 1/16 166/373 |

(Continued)

*Primary Examiner* — Christopher J Sebesta
(74) *Attorney, Agent, or Firm* — Shawn Hunter

(57) ABSTRACT

An operating system for a barrier valve or safety valve is responsive to increments in annulus or tubing pressure. An indexing device controls valves that selectively direct pressure applied to one side of an operating piston or the other for attaining the open and closed positions of the barrier valve. One such indexing device can be a j-slot. Other devices that operate a pair of hydraulic valves in tandem for pressure direction to one side of an actuation piston or another are contemplated. The system needs no electric power and there are no control lines needed to run below the production packer in the case of using annulus pressure to actuate the piston or at all if access to tubing pressure is provided from the vicinity of the barrier valve components.

7 Claims, 7 Drawing Sheets

(56) References Cited

U.S. PATENT DOCUMENTS

| | | | | |
|---|---|---|---|---|
| 2015/0233209 | A1* | 8/2015 | Vick, Jr. | E21B 34/10 166/373 |
| 2016/0201448 | A1* | 7/2016 | Patel | E21B 47/007 73/152.51 |

* cited by examiner

TUBING OR ANNULUS PRESSURE OPERATED BOREHOLE BARRIER VALVE

FIELD OF THE INVENTION

The field of the invention is deep set barrier valves in a borehole and more particularly where the actuation is accomplished with cycled tubing or annulus pressure in conjunction with an indexing device to avoid the need for external control lines outside the tubular string to the barrier valve.

BACKGROUND OF THE INVENTION

Typically barrier valves or subsurface safety valves are put in a tubular string thousands of meters below a surface location and operated by one or more control lines. As wells get deeper and deeper a concern has arisen among operators that the control line or lines that are used to actuate the barrier valves or safety valves can be damaged when running in the tubular string. Typically control systems for such valves have a one line or two line system to an actuation piston that operates the barrier valve. A two line system is pressure balanced from the perspective of control line hydrostatic pressure because the lines run parallel to each other to the same depth and have the same hydrostatic pressure in each line. One line systems extend a control line to one side of a piston and the other side is referenced to a pressurized compressible gas chamber or a substantial spring to offset the hydrostatic pressure in the single control line.

Many control systems for barrier or safety valves have focused on mechanisms to ensure failsafe operation in the event of seal leaks of actuation piston seals or in the event of a control line shearing or otherwise failing. In those emergency situations reference lines from the control system to the annulus for example have been used to insure that regardless of the nature of the system component failure, a net force on the actuation piston is applied and the valve or tool goes to its designated fail safe position, which is typically the closed position. Typical of such designs are U.S. Pat. Nos. 7,743,833; 7,434,626; 6,173,785 and 6,866,101. One reference suggests the use of tubing or annulus pressure to raise a workstring to create potential energy in the weight of the string so that when needed to go to a failsafe position the weight of the string can act as kinetic energy to move the tool to the failsafe position upon failure of the control line system to normally operate the took. This reference is U.S. Pat. No. 8,162,066. Also relevant are U.S. Pat. Nos. 8,056,643 and 6,230,807.

FIGS. 1-3 show different positions of a barrier valve using dual control lines 10 and 12 leading to an actuator housing 14 that has opposed compartments 16 and 18 on opposed sides of actuating piston 20. A schematically illustrated actuation linkage 22 is connected to valve member 24 that is typically a ball with a passage 26 through it that is selectively aligned with passage 28 of the schematically illustrated tubular string 30 that typically has a production packer 32. In FIG. 1 the actuating piston is midway in its travel representing a partial alignment of passage 26 with passage 28. In FIG. 2 piston 20 has been pushed uphole with pressure in one of the control lines 10 and 12 applied and pressure in the other of the two control lines removed. Conversely, in FIG. 3 the pressure is applied to the other of the two control lines and removed from the other of the two control lines to get the piston 20 to move downhole to a stop position for a fully open position of passage 26 aligned with passage 28.

As previously explained there are installations, particularly offshore where depths can get to 10,000 meters and beyond and the deep placement of the barrier valve to meet regulations for redundant isolation entails long control line runs that not only slow the tripping into the hole procedure but also present a risk of loss of use of the barrier valve if one or both control lines is damaged when running into hole. The present invention addresses this issue with a system that can operate using annulus or tubing pressure. Cycles of applied annulus or tubing pressure will configure a known shuttle valve to direct the available annulus or tubing pressure to the top side or underside of an actuating piston so that the barrier valve can be actuated between an open and closed position when the available pressure is properly directed and removed. The system can be fully hydro-mechanical. Using check valves the applied pressure connection and the vent connection can be in the same space or one can be in the annulus and the other in the tubing. These and other features of the present invention will be more readily understood by those skilled in the art from a review of the description of the preferred embodiment and the associated drawings while recognizing that the full scope of the invention is to be determined by the appended claims.

SUMMARY OF THE INVENTION

An operating system for a barrier valve or safety valve is responsive to changes in annulus or tubing pressure. A known indexing device in a new application selectively directs pressure applied to one side of an operating piston or the other for attaining the open and closed positions of the barrier valve. Another such indexing device can be a j-slot. Other devices that operate a pair of hydraulic valves in tandem for pressure direction to one side of an actuation piston or another are contemplated. The system needs no electric power and there are no control lines needed to run below the production packer in the case of using annulus pressure to actuate the piston or at all if access to tubing pressure is provided from the vicinity of the barrier valve components.

DETAILED DESCRIPTION OF THE PREFERRED EMBODIMENT

Figure 1:
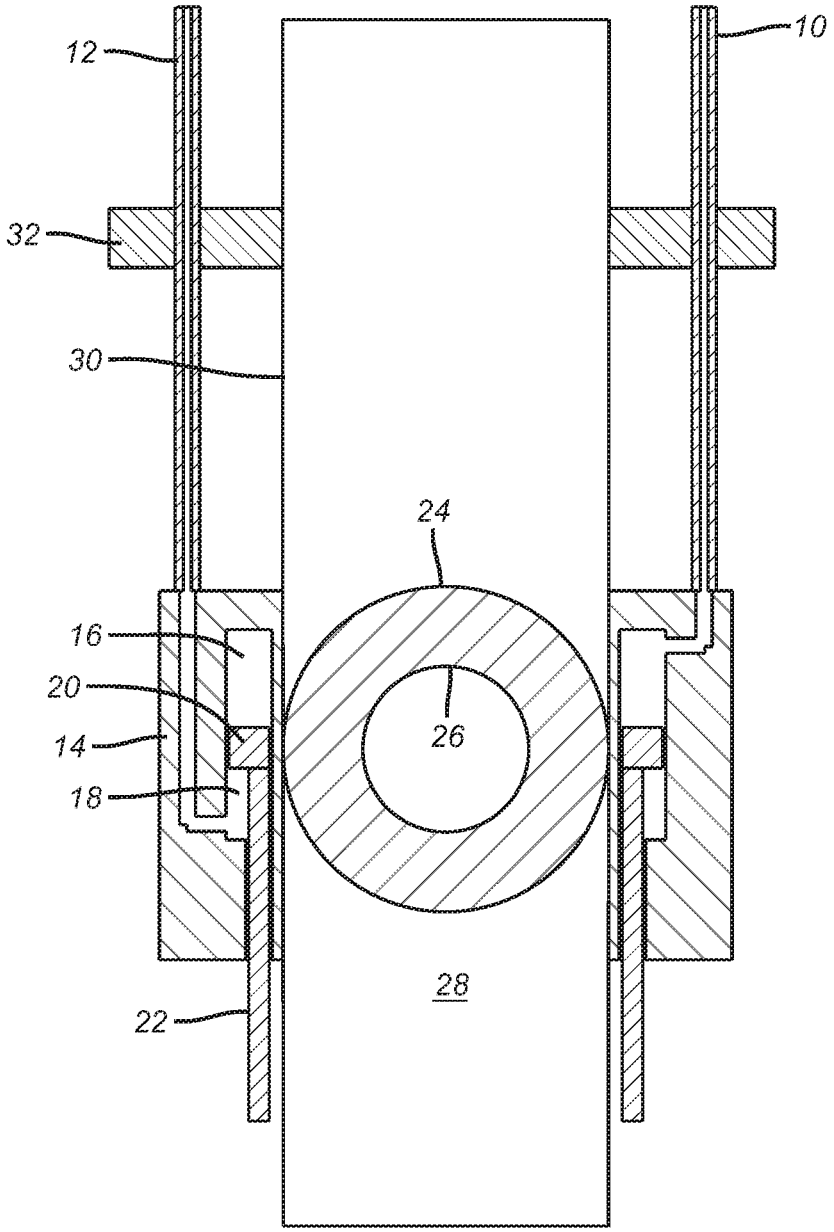
(PRIOR ART) FIG. 1
FIG. 1 is a prior art dual control line actuation system for a barrier valve with the valve in the half open position.
Figure 2:
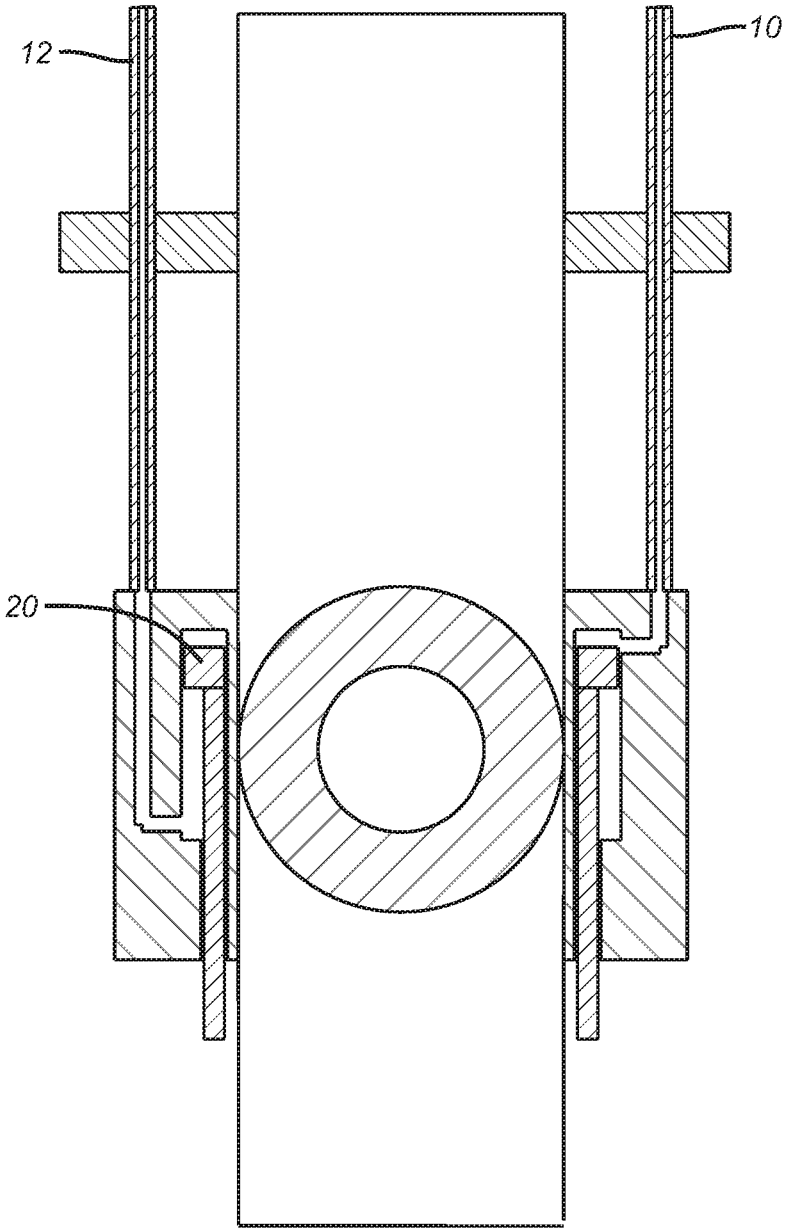
(PRIOR ART) FIG. 2
FIG. 2 is the view of FIG. 1 with the barrier valve in the closed position.
Figure 3:
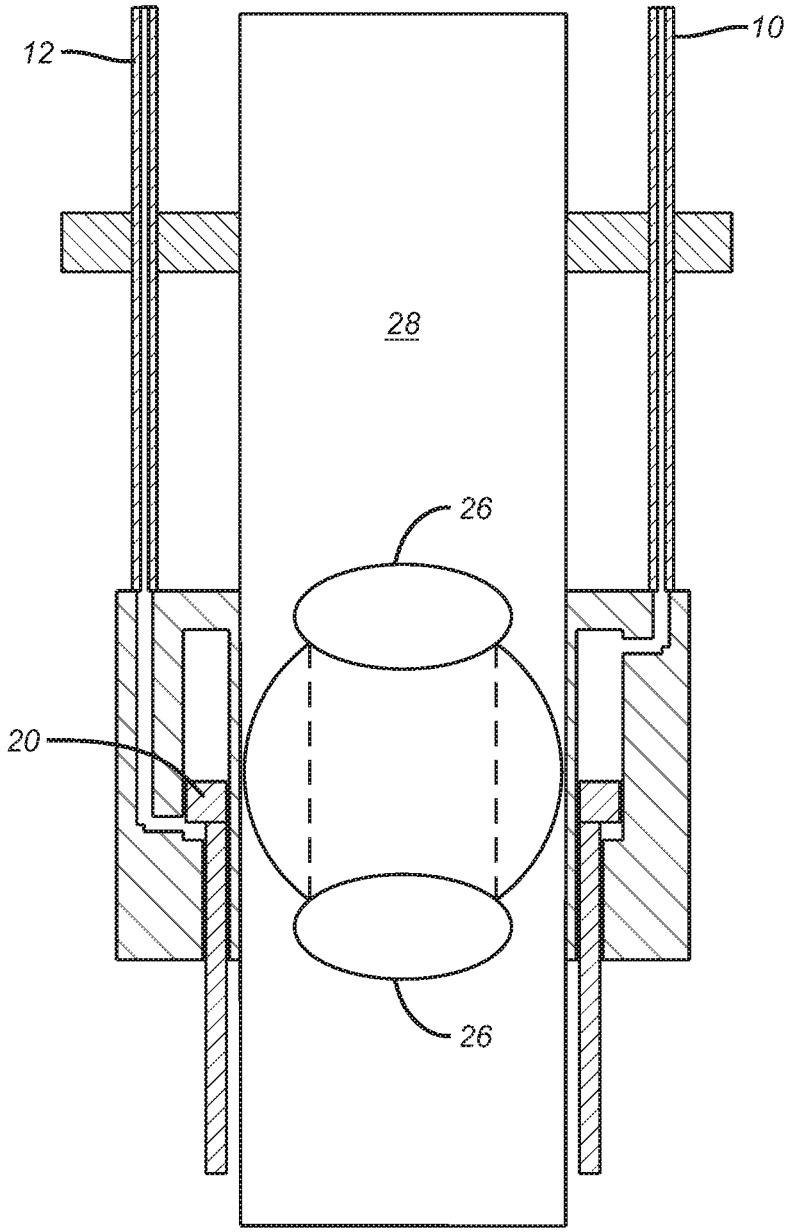
(PRIOR ART) FIG. 3
FIG. 3 is the view of FIG. 2 with the barrier valve in the fully open position.
Figure 4:
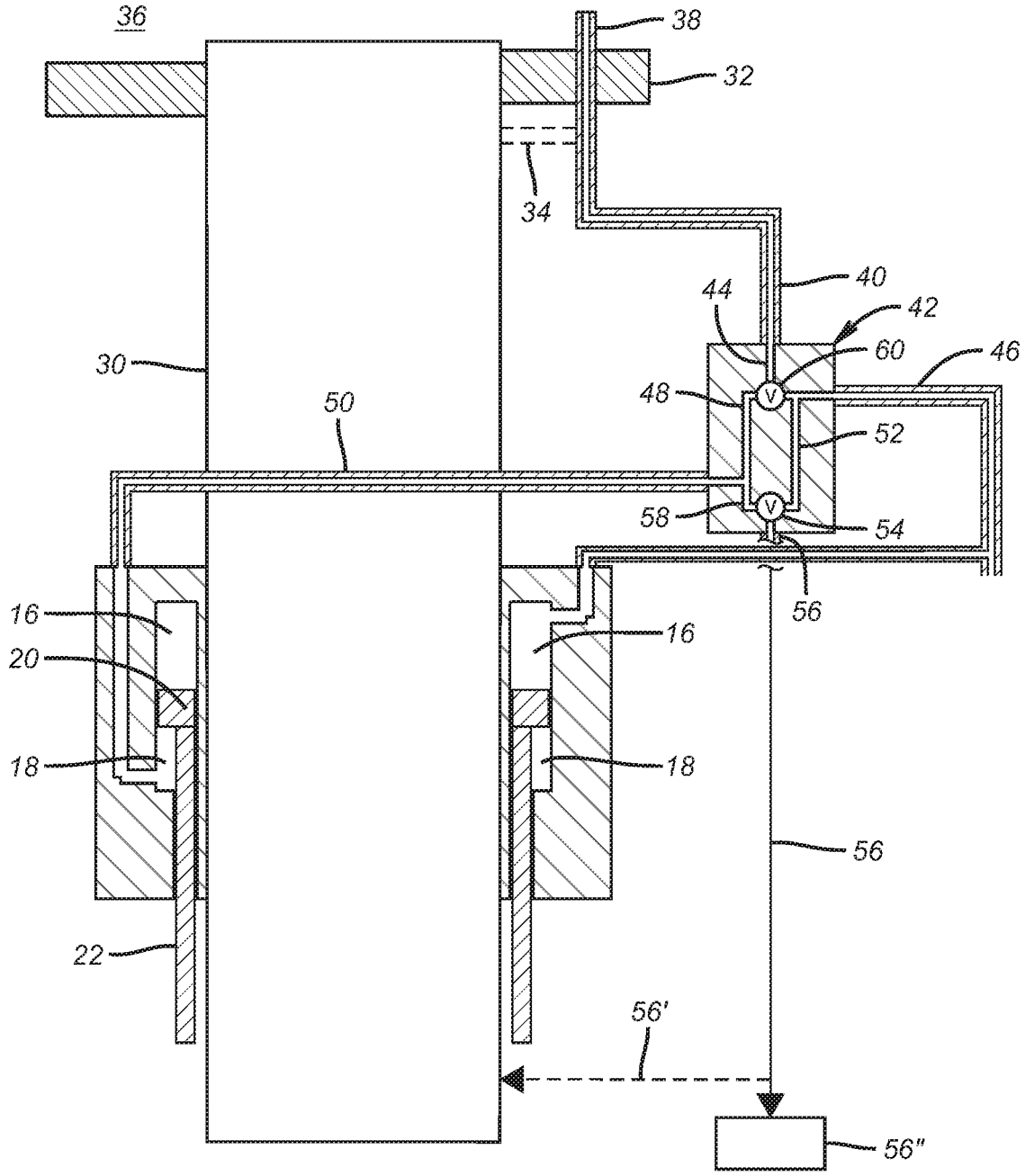
FIG. 4 is schematic illustration of a tubing or annulus operated actuation system showing the valve manifold responsive to pressure cycles for aligning the provided pressure to above or below the actuation piston.

Referring to FIG. 4, the valve member 24 is omitted so that other parts of the actuation system can be more clearly illustrated. The actuation piston 20 with opposed chambers 16 and 18 are the same as described in FIGS. 1-3. The pressure that will ultimately move the piston 20 is different than in FIG. 1-3 where control lines 10 and 12 running from a surface location were used. Instead there are two alternative sources of fluid actuation pressure. One source is dashed line 34 that starts through the wall of the tubular string 30. The other alternative source is the upper annulus 36 using a line 38 that just comes through the production packer 32. Line 38 gives access to the upper annulus 36 from a surface location to inlet 40 of manifold assembly 42. Alternatively the tubing string 30 is the source of pressure through line 34 that is connected to inlet 40.

Manifold assembly 42 has an inlet line 44 that branches to lines 46 and 48. Line 46 leads to chamber 16 and line 48 leads to line 50 that leads into chamber 18. Line 52 leads into valve 54 which selectively connects line 52 to vent 56. Line 58 leads from lines 48 and 50 into valve 54 for selective alignment with the vent 56. Valve 60 selectively connects line 44 to lines 48 or 46.

Pushing piston 20 down requires raising pressure in chamber 16 and venting chamber 18. The way this is done is that the pressure applied in line 44 is directed to line 46 using valve 60 and valve 54 is aligned to direct line 50 from chamber 18 to the vent connection 56. Conversely, to push piston 20 up pressure from line 44 is directed through valve 60 to line 50 and pressure in chamber 18 is directed to vent 56 through line 46 and valve 54.

Figure 5:
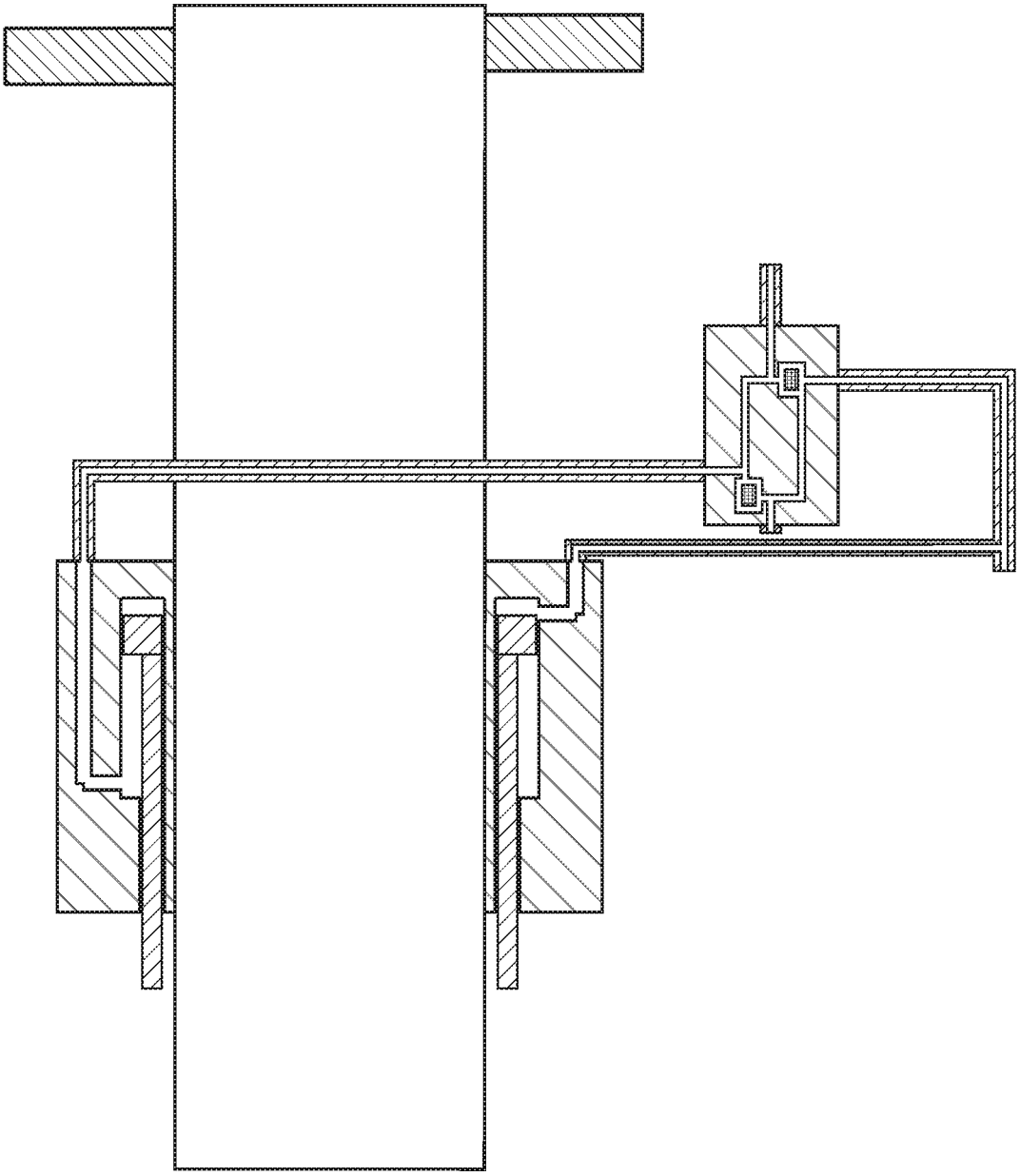
FIG. 5 is the view of FIG. 4 with the actuator moved to the barrier valve closed position.
Figure 6:
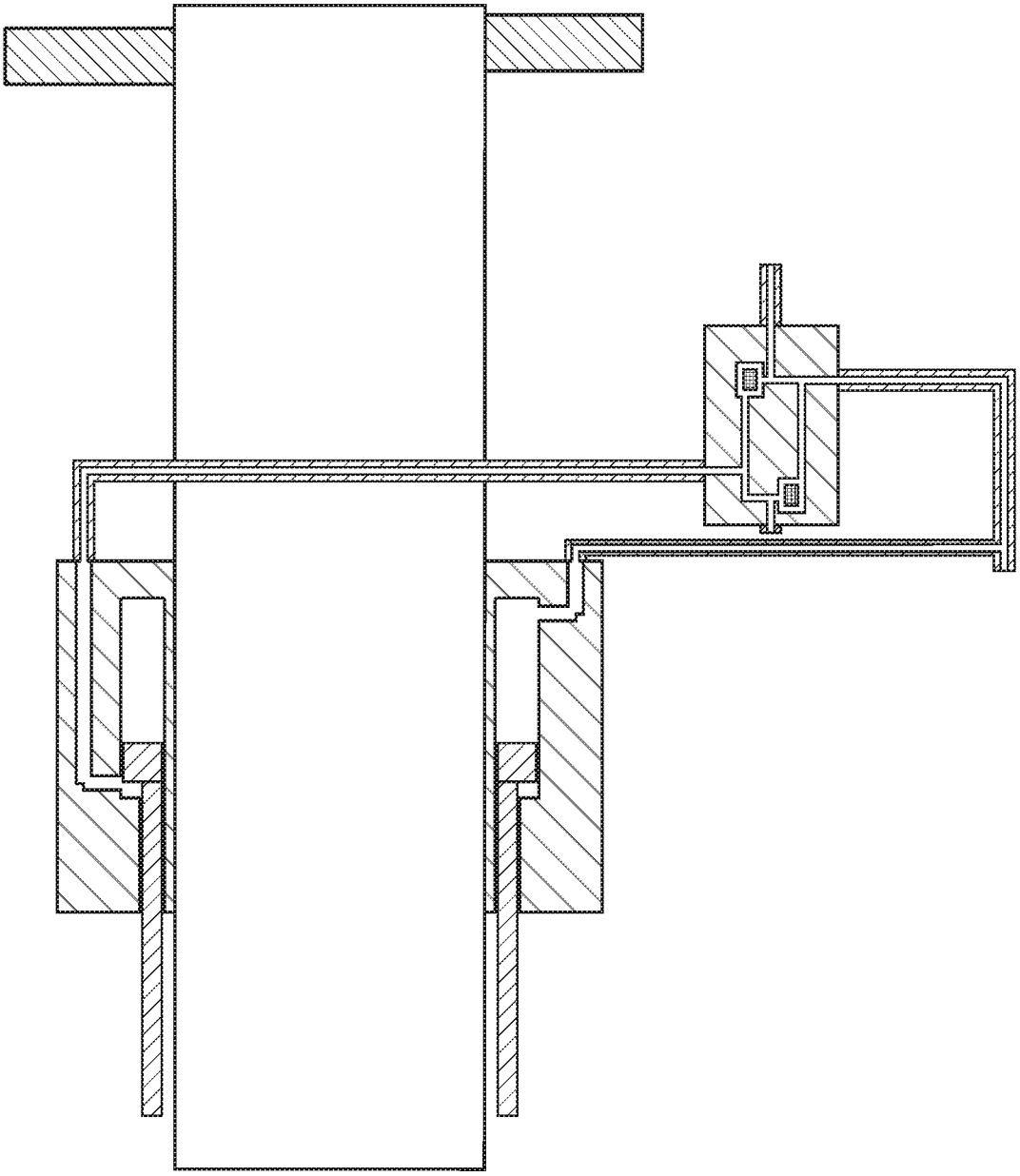
FIG. 6 is the view of FIG. 4 with the barrier valve in the fully open position.

The valves 54 and 60 are schematically illustrated and can have one or more indexing features included so that a predetermined number of applications and removals of pressure in line 44 from upper annulus 36 or tubing string 30 will operate these multi-directional valves into the needed alignment for moving piston 20 from the barrier open position of FIG. 6 to the part open position of FIG. 4 to the fully closed position of the barrier valve in FIG. 5.

Those skilled in the art will appreciate that what is described is a hydraulically operated piston that is double acting and can move in opposed direction for opposed open or closed positions of a barrier valve or some other tool. Through the use of a manifold assembly at least two flow direction orientations can be adopted so that hydraulic pressure can be applied to one side of a piston while an opposing side of the piston is connected to a vent line to a lower zone. The motive pressure can be either from the annulus or from the tubing. The vent can be directed to a lower pressure zone. For example if the motive pressure is from the tubing the vent outlet can be in the annulus and vice versa. Another way to get the needed differential is to provide a housing leading from the vent that is at atmospheric or low pressure whether the vent is in the annulus or in the tubing or the tubing wall. The unique source of motive pressure is coupled to an indexer to configure valves 54 and 60 to direct pressure on one side of piston 20 and relieve pressure from an opposite side of piston 20 to get piston 20 moving in the desired direction. The indexer can be associated with each valve or one can be used that repositions both valves in tandem. The indexer simply allows the use of a predetermined number of pressure cycles before valve movement exists. It can be a two position indexer where simply adding pressure reconfigures the valves 54 and 60 and moves the piston 20. Different manifold possibilities are envisioned as long as there is the ability to make piston 20 double acting with a discrete pressure source and a discrete vent destination. A common valve member that actuates the needed flow configurations with movement of a common stem in opposed directions can be used as in a shuttle valve or valves with return springs to get the needed flow configurations for upward or downward piston 20 movement. In fact, manifold assembly 42 is a repurposed existing product offered by Baker Hughes, a GE company under the name of In Force Single Line Switch Product Family No. H81503. This product is described as follows when used for different applications with a single control line:

"The InForce™ Single Line Switch (SLS) enables the usage of a hydraulic valve or choke designed with a balanced piston to be operated with a single control line rather than two control lines. The SLS is a modular hydraulic device that can be mounted above an HCM-PlusTM or HCM-ATM choke. The open and close ports of the valve attach to dedicated ports within the SLS. The single control line is then run to surface minimizing the overall number of control lines within the system. The SLS receives pressure from a single hydraulic input and uses a spool and sleeve assembly, J-slot, and spring to alternate this pressure between the open and close port of the HCMTM. For example, if a given HCM valve is closed, applying pressure to the SLS input will first open the valve, allowing the desired zone to be produced. Then when it is time to isolate the zone, applying pressure to the same line will close the valve."

Figure 7:
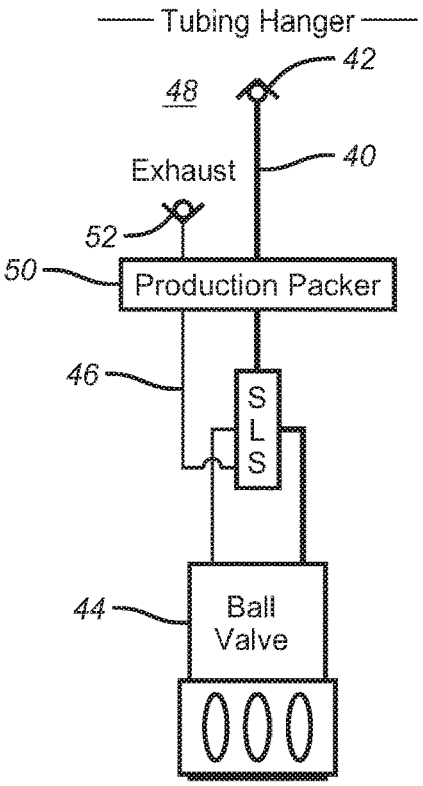
FIG. 7 is a simplified view of FIGS. 4 and 5 showing the barrier valve open and a pressure source and vent location in the upper annulus.
Figure 8:
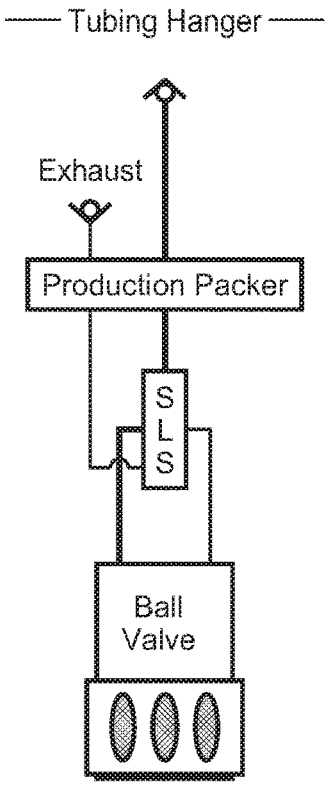
FIG. 8 is the view of FIG. 7 with the barrier valve closed.
Figure 9:
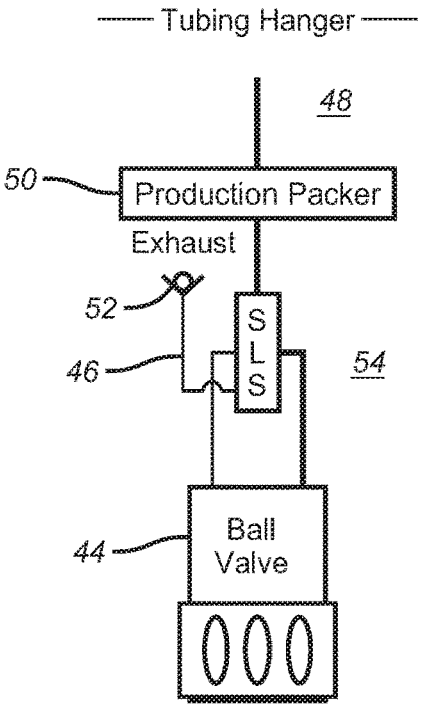
FIG. 9 is the view of FIG. 7 with the pressure connection in the upper annulus and the exhaust connection in the lower annulus below the production packer and the barrier valve open.
Figure 10:
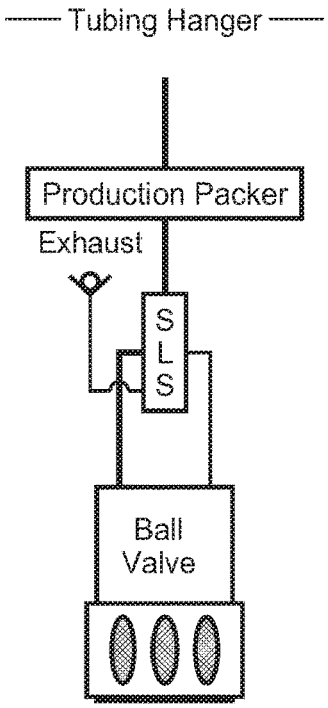
FIG. 10 is the view of FIG. 9 with the barrier valve closed.

The original intended application of this valve is modified so that it in essence can operate with no control lines to the surface. Pressure can be provided from an upper annulus to a connection above a production packer and the vent connection can be directed into the same upper annulus. In this configuration illustrated in FIGS. 7 and 8 applying pressure in line 40 will open check valve 42 and cause barrier valve 44 to go from the open position of FIG. 7 to the closed position of FIG. 8. Since the exhaust line 46 is in the same upper annulus 48 as line 40 above production packer 50, the check valve 52 on the exhaust line 46 will not open when pressure from upper annulus 48 is applied to line 40. However the internal components of the multifunction valve SLS will still allow the barrier valve to move closed. As pressure in the upper annulus is reduced below the built up pressure in line 46 which is trapped in the SLS due to the presence of check valve 42, the check valve 52 will open into annulus 48 and allow the trapped pressure in the SLS to vent to upper annulus 48 above the production packer 50. Another application of pressure in annulus 48 will then reopen barrier valve 44 by applying pressure to an opposite side of the double acting piston 20 as described above. FIGS. 9 and 10 only differ from FIGS. 7 and 8 in that the pressure line 40 and the vent line 46 are on opposite sides of the production packer 50. The check valve 42 is not needed as lower annulus 54 allows check valve 52 to open when upper annulus 48 pressure is raised above lower annulus 54 pressure. In FIGS. 7 and 8 since the pressure application and venting were in the same space the check valve 42 was needed to hold the raised pressure in the SLS until upper annulus 48 pressure was reduced.

The described system does not require electric power and is fairly simple to construct. It avoids the need for control lines to extend beyond a short distance above the production packer 32. When actuating with tubing pressure control lines are not needed at all. If the input pressure is from the upper annulus 36 the vent can go to the tubing through line 56' or to a low pressure chamber 56" that can be located in the annulus or the tubing or the tubing wall. If the input pressure is from the tubing string 30 the vent line 56 can lead to a low pressure chamber 56" as previously described or anywhere in the annulus above or below packer 32. If the annulus below set packer 32 is at a lower pressure than the upper annulus 36 then the input pressure can be from the upper annuls 36 and the vent 56 can terminate in a lower annulus below the production packer 32.

The above description is illustrative of the preferred embodiment and many modifications may be made by those skilled in the art without departing from the invention whose scope is to be determined from the literal and equivalent scope of the claims below:

We claim:

1. An actuation assembly for a tubular string mounted barrier valve, comprising:

a housing;

a double acting piston within the housing operably connected to a valve member such that movement of said piston in a first direction opens the barrier valve and movement of said piston in a second direction closes the barrier valve;

opposed compartments defined within the housing on opposed sides of the double acting piston, the opposed compartments comprising a first compartment and a second compartment;

a hydraulically operated valved manifold comprising an inlet pressure source fluidly coupled to a central flowbore of the tubular string and which passes laterally through a wall of the tubular string, said manifold selectively directing said inlet pressure source into said first compartment to flow fluid from the second compartment to a lower pressure location as the double acting piston is moved in a first direction; and said manifold further selectively directing said inlet pressure source into said second compartment via actuation of at least one valve within the valved manifold to flow fluid from the first compartment to the lower pressure location as the double acting piston is moved in a second direction.

2. The assembly of claim 1, wherein:

said lower pressure location is in a lower annulus defined below a production packer.

3. The assembly of claim 1, wherein:

said lower pressure location is a chamber with lower pressure than said inlet pressure source.

4. The assembly of claim 1, wherein:

said lower pressure location is an annular space surrounding said tubular string.

5. The assembly of claim 1, wherein:

the valved manifold includes first and second valves within the manifold; and said first and second valves of the valved manifold are selectively operated by said inlet pressure source.

6. The assembly of claim 5, wherein:

cycles of increasing and decreasing pressure from said inlet pressure source reconfigures the positions of said first and second valves in tandem.

7. The assembly of claim 6, wherein:

said valved manifold further comprising at least one indexing device such that after a predetermined number of said cycles of increasing and decreasing pressure, said valves are reconfigured to change movement direction of said double acting piston.

* * * * *